US008199100B1

(12) United States Patent
Barnhoefer

(10) Patent No.: US 8,199,100 B1
(45) Date of Patent: Jun. 12, 2012

(54) DISPLAY ARRANGEMENT AND APPROACHES THEREFOR

(75) Inventor: Ulrich Tobias Barnhoefer, Sunnyvale, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 1369 days.

(21) Appl. No.: 11/756,104

(22) Filed: May 31, 2007

Related U.S. Application Data

(60) Provisional application No. 60/809,501, filed on May 31, 2006.

(51) Int. Cl.
*G09G 3/36* (2006.01)

(52) U.S. Cl. ..... 345/102; 345/87; 345/89; 345/92; 345/95; 345/100

(58) Field of Classification Search ..... 345/7, 87–102, 345/157, 158, 173, 419, 421, 426, 690; 348/118, 348/744, 630, 631, E9.027, E5.139; 359/844; 382/154, 254, 298; 340/425.5; 378/205, 378/98.3; 353/31, 122
See application file for complete search history.

(56) References Cited

U.S. PATENT DOCUMENTS 5,311,568 A * 5/1994 McKee et al. ..... 378/205
5,533,087 A * 7/1996 Snoeren ..... 378/98.3
6,231,185 B1 * 5/2001 Pipa ..... 351/208
6,714,186 B1 * 3/2004 Mosier et al. ..... 345/104
6,795,053 B1 * 9/2004 Funamoto et al. ..... 345/102
7,064,740 B2 * 6/2006 Daly ..... 345/102
7,088,321 B1 * 8/2006 Parker ..... 345/83
7,358,941 B2 * 4/2008 Ono et al. ..... 345/82
7,364,306 B2 * 4/2008 Margulis ..... 353/31
7,414,608 B2 * 8/2008 Funamoto et al. ..... 345/102
7,499,017 B2 * 3/2009 Daly ..... 345/102
7,505,028 B2 * 3/2009 Daly ..... 345/102
7,573,457 B2 * 8/2009 Daly ..... 345/102
7,616,172 B2 * 11/2009 Lin et al. ..... 345/8
2002/0101569 A1 * 8/2002 Knox ..... 353/31
2003/0090455 A1 * 5/2003 Daly ..... 345/102
2004/0109612 A1 * 6/2004 Park et al. ..... 382/254
2004/0145457 A1 * 7/2004 Schofield et al. ..... 340/425.5
2004/0234163 A1 * 11/2004 Lee et al. ..... 382/298
2005/0083295 A1 * 4/2005 Daly ..... 345/102
2005/0195223 A1 * 9/2005 Nitta et al. ..... 345/690
2006/0022917 A1 * 2/2006 Kim ..... 345/83
2006/0126171 A1 6/2006 Whitehead et al.
2007/0081344 A1 * 4/2007 Cappaert et al. ..... 362/373
2007/0120806 A1 * 5/2007 Schmidt et al. ..... 345/102
2007/0126691 A1 * 6/2007 Lin et al. ..... 345/102
2007/0152954 A1 * 7/2007 Daly ..... 345/102
2007/0159450 A1 * 7/2007 Daly ..... 345/102
2008/0284677 A1 * 11/2008 Whitehead et al. ..... 345/1.3

* cited by examiner

*Primary Examiner* — Prabodh M Dharia
(74) *Attorney, Agent, or Firm* — Crawford Maunu PLLC

(57) ABSTRACT

Desirable control of displays is facilitated. According to an example embodiment of the present invention, a light arrangement provides light to form an image using a plurality of light sources (e.g., light generating or producing elements), a control arrangement and an attenuation arrangement. Each light source provides light for a portion of the image and the control arrangement independently controls the amount of light generated by each source according to a brightness of the portion of the image for which each source is providing light and, for certain embodiments, facilitating desirable power savings and/or contrast. The attenuation arrangement selectively passes light from the light sources to form the image.

24 Claims, 7 Drawing Sheets

DISPLAY ARRANGEMENT AND APPROACHES THEREFOR

RELATED PATENT DOCUMENTS

This patent document claims the benefit, under 35 U.S.C. §119(e), of U.S. Provisional Patent Application No. 60/809,501, filed May 31, 2006 and entitled: "Display Arrangement and Approaches Therefor."

FIELD OF THE INVENTION

The present invention relates generally to display arrangements and approaches and, more particularly, to a light attenuating display having multiple light sources.

BACKGROUND

Visual displays (e.g., televisions and monitors) are designed and implemented using many different approaches. Cathode ray-tube displays have been in use for some time. The thickness of a conventional cathode ray tube television set is dependent upon the length of the cathode ray tube and the cathode ray tube length generally increases in proportion to the display size of the television. Increasingly, such displays are designed with greater displayable area and decreased thickness. Often, decreasing the thickness of the displays increases the difficulty of providing sufficient power and of removing excess heat from the display.

Some relatively newer visual display types are implemented using a light generator and a light attenuating arrangement. The attenuating arrangement varies from system to system. The attenuation is often accomplished by varying the amount of light absorbed and/or redirected prior to the light reaching a viewable portion of the display. These types of attenuating displays do not use cathode ray tubes, and therefore, can often be thinner than a conventional cathode ray tube television.

A specific example of an attenuating display is a liquid crystal display (LCD). Conventional LCD displays are designed with a single light generating element (a backlight) that operates at a constant brightness level. The power dissipation of conventional backlights is linked to the peak brightness for which the display is designed, and darker images require severe attenuation by the LCD front panel to remove the excess light produced, further increasing power consumption.

Another type of attenuating display is a display employing Digital Light Processing™ (DLP®) technology, in which small mirrors on at least one microchip selectively direct light towards or away from a display. Digital Light Processing™ technology and DLP® technology are registered trademarks of Texas Instruments, Inc. Attenuation is achieved via the amount of light directed towards, relative to away from, the display.

Some example LCD displays implement light generating and light attenuating elements in a sandwiched way. For a projection type display (e.g., with DLP or LCOS light attenuators), the light attenuating and the light generating elements are part of a complex optical path. In the first case the image is directly viewable, in the latter case it is projected onto a screen material for indirect view.

Attenuation type displays have become a ubiquitous electronics component, from large high-brightness home entertainment displays to small battery-operated mobile displays. Regardless of size or application, power dissipation is a key limiting factor of display performance. In the case of large displays, size and brightness levels are primarily limited by power dissipation and cooling. For example, more than 1 kW are required to achieve 2000 cd/m$^2$ on a 30" LCD given an efficient fluorescent backlight. While larger sizes and higher brightness are desirable, the power-dissipation by itself, and additionally the cooling technology that would be needed, impede the development of such products with reasonable weight, price, or fan-noise levels. Power consumption is also critical for small, battery-operated, mobile LCD displays. The power consumption associated with the display is a large fraction of the total energy dissipated by mobile devices, often exceeding 50%. Thus, a significant reduction in display power consumption is essential for the continued successful development of mobile devices, enabling a reduction in battery size, and hence, device size, or making possible a substantially longer battery runtime.

These and other characteristics present challenges to the implementation of attenuating displays.

SUMMARY

The present invention is directed to overcoming the above-mentioned challenges and others related to the types of applications discussed above and in other applications. These and other aspects of the present invention are exemplified in a number of illustrated implementations and applications, some of which are shown in the figures and characterized in the claims section that follows.

According to an example embodiment of the present invention a light arrangement provides light to form an image. The arrangement includes a plurality of light generators, with each generator providing light for a portion of the image. A controller independently controls the amount of light generated by each light generator in response to a brightness of the portion of the image for which each light generator is providing light. An attenuation arrangement selectively passes light from the light generator.

The above summary is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

DETAILED DESCRIPTION

Figure 1:
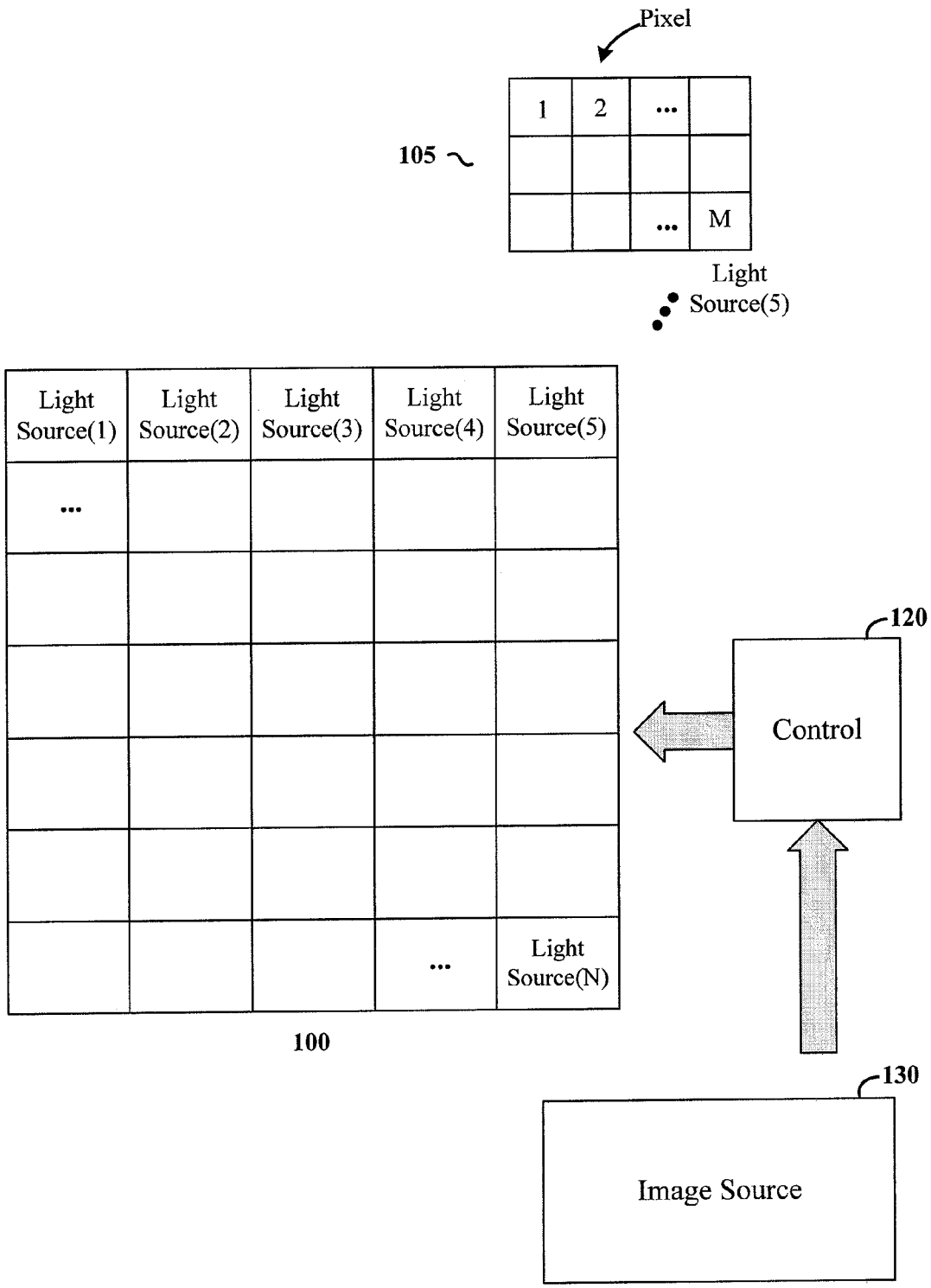
FIG. 1 is a block diagram of an attenuating display, according to an example embodiment of the present invention.

The present invention is believed to be applicable to a variety of attenuating displays and approaches for implementing the same. Such approaches include, for example, facilitating a reduction in display power consumption and facilitating thermal heat dissipation. While the present invention is not necessarily limited to such applications, an appreciation of various aspects of the invention is best gained through a discussion of examples in such an environment.

According to one embodiment, a backlight source having spatially adaptive light generators is implemented in an attenuating display, facilitating desirable power dissipation and contrast with the display. Each light generator (e.g., a source of light) is a relatively high-brightness light generator controlled independently, relative to at least one other of the light generators, to illuminate a portion of the attenuating display at a brightness corresponding to the control. Example light generators used with the attenuating display include LEDs, cold-cathode florescent lamps, and other light sources sufficiently bright for a particular imaging application. Different light generators are thus controlled at different levels of brightness to facilitate a relative power savings (i.e., when illuminating darker portions of a display, relative to lighter portions of the display), and/or to facilitate contrast in a displayed image. With these approaches, light generators are controlled to achieve one or both of desirable image contrast and reduced relative power consumption.

In the context of this and other example embodiments discussed herein, attenuating displays are displays that include a light generator (e.g., a light source) for illuminating a displayable area and an attenuation device for reducing the amount of light that reaches the displayable area. Numerous types of attenuation displays are applicable to various embodiments of the present inventions including LCD, DLP® technology and liquid crystal on silicon (LCOS). In addition, such displays involve both direct view displays (e.g., for an LCD television) and projection displays (e.g., a projector that projects an image onto a screen) with attenuating arrangements.

In some example embodiments, the attenuating device attenuates light by facilitating the absorption of light prior to the light reaching the displayable area, by directing light away from the displayable area, or by otherwise inhibiting light from reaching the displayable area. In one type of LCD technology, the attenuation is accomplished by absorbing some of the light using polarization of the light. Comparatively, DLP® technology attenuates the light reaching the displayable area by rapidly controlling whether the light is directed to the displayable area. Various embodiments are directed to applications with each of these types of attenuation. In this manner, the total amount of light reaching the displayable area is attenuated over time; when the light is not directed to the displayable area it is absorbed or otherwise inhibited from reaching the displayable area.

In another embodiment, light sources are mounted on printed circuit boards (PCBs) that facilitate the dissipation of heat from the light sources to an opposite side of the PCB using thermal channels that thermally couple the light sources to the opposite side of the PCB. These thermal channels include a thermally-conductive material such as metal that conducts heat from an area near the light sources to the opposite side of the PCB. In certain applications, heat is removed from the opposite side of the PCB using, for example, a cooling fluid such as air or water.

In yet another embodiment, the power dissipation of the light sources is reduced by reducing the brightness of the light sources based upon the image displayed. Generally, when a particular image or portion thereof is amenable to use with reduced brightness, such as when the image is of a dark scene, the brightness of some or all of the light sources is reduced, thereby reducing the power dissipation of the light sources.

According to another embodiment of the present invention, an array of light sources and associated driver electronics is mounted on a backlight PCB. The front of the backlight PCB is populated with high brightness light sources. The brightness and number, of the light sources is selected depending upon the desired characteristics of the display. For instance, 63 light sources that exhibit a luminous flux of 40 lumens each can be implemented for a 12.1" display. The back of the backlight PCB contains driver electronics that reduce or otherwise adjust the power consumption of the display (or correspondingly, power supplied to the light sources) by controlling the brightness of the light sources. Pulse-width modulation or similar methods can be used to control the light source brightness. The control signals are provided in real time through a graphics controller arrangement and facilitate the display of both still images and video.

In some instances, such a light source array and display are scalable. For example, the display can be implemented using a 12.1" display with a 9×7 backlight light source array and a 1024×768 pixel front panel, a 32" display with a 18×14 backlight light source array and a 1366×768 pixel front panel, or other combinations. Other implementations are directed to LED arrays having greater density, such as those involving one thousand or more LEDs for a 32" display as discussed above.

Turning now to the figures, FIG. 1 shows a block diagram of an attenuating display arrangement, according to another example embodiment of the present invention. The attenuating display arrangement includes a display 100 having light source zones 1 to N, a control 120 and an image source 130. The attenuating arrangement generates a visual display by controlling attenuation components representing pixels of an image, with each pixel having a color and brightness component. Where appropriate, the attenuation components include a color filter to produce different colored images.

The attenuation components attenuate light from the light sources to produce a desired visual display. The image source 130 provides image data to the control 120 using a format such as HDMI, DVI, composite, VGA, and analog broadcast formats. The control 120 controls the light sources 1-N and attenuating components (e.g., liquid crystal or mirror components).

In one embodiment, control 120 determines a desirable brightness for each light source and adjusts the brightness of each light source accordingly. This can be accomplished by determining the brightness of the brightest pixel for a zone or area that the light source illuminates. For instance, an example illuminated zone 105 (pixel array) is shown as corresponding to (and illuminated by) the light source 5, having pixels 1 to M. Control 120 determines the pixel within the zone 105 that requires the brightest setting. Based upon the required brightness of the brightest pixel, control 120 adjusts the brightness of light source 5. The brightest pixel's attenuation is set to a low value (e.g., such that the brightness of light source 5 matches that displayed for the brightest pixel), and the attenuation of each of the other pixels is determined according to the brightest pixel. This adjustment of brightness and attenuation is particularly useful for controlling the power dissipation of the display.

One example application involving the illuminated zone 105 is as follows. When the brightest pixel is found to be a brightness of 5,000 on a scale from 1 to 10,000, with 1 being the darkest and 10,000 the brightest. Control 120 sets light source 5 to a reduced brightness and the brightest pixel to a low attenuation (near zero) of the light from light source 5. The brightness of each of the remaining pixels is then compared to the brightest pixel or to the brightness of light source 5 (i.e., 5,000/10,000) and set to half the attenuation value that would have been necessary if light source 5 was at a brightness corresponding to 10,000.

Figure 2A:
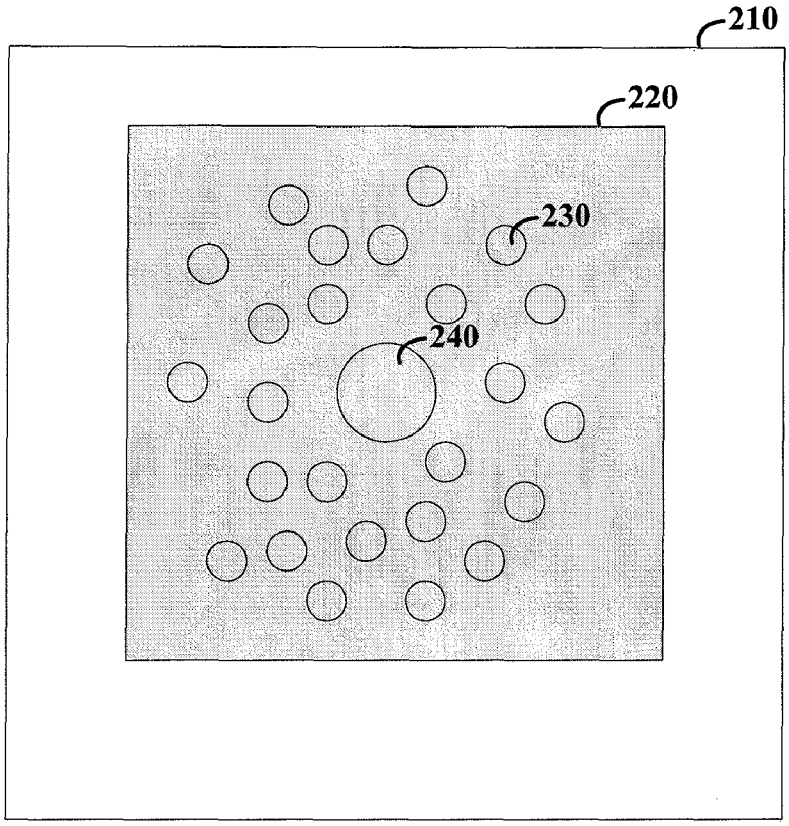
FIG. 2A shows a light source arrangement and thermal cooling arrangement, according to another example embodiment of the present invention.

FIG. 2A shows a light source arrangement that includes cooling device 210, PCB 220, thermal channel 230 and light source 240, according to another example embodiment of the present invention. FIG. 2A shows a single light-source arrangement; however, several such arrangements can be used to provide backlight for an attenuating display. In an alternate embodiment, several such arrangements are implemented on a single PCB.

PCB 220 contains several thermal channels near light source 240. These thermal channels provide cooling to light source 240 by conducting heat from a light source side of PCB 220 (with light source 240) to a cooling side of the PCB 220, having cooling device 210. On the light source side of PCB 220, light source 240 is connected to a thermally conductive material that covers the portion of PCB 220 containing thermal channels. For instance, the thermally conductive material may be metal that is soldered or otherwise connected to the thermal channels 230. On the cooling side of PCB 220, the cooling device 210 is connected to the thermal channels.

Cooling device 210 can be implemented using a number of different heat dispersion devices. For instance, cooling device 210 can be implemented as a metal heat sink that is soldered or otherwise connected to the thermal channels, as a peltier tape, as a conductive (fluid-based) heat exchanger or other type of device. In another instance, the PCB is constructed with a thermally-conductive layer, such as copper, within the PCB that assists in dissipating heat. In certain applications, the thermally-conductive layer dissipates the heat generated without additional cooling means. Accordingly, heat from light source 240 can be transferred through the thermal channels and dissipated by cooling device 210.

In one embodiment, PCB 220 is constructed using standard flame resistant (FR4) material. Cooling device 210 is manufactured separately from PCB 220 and attached using reflow or similar soldering techniques.

Figure 2B:
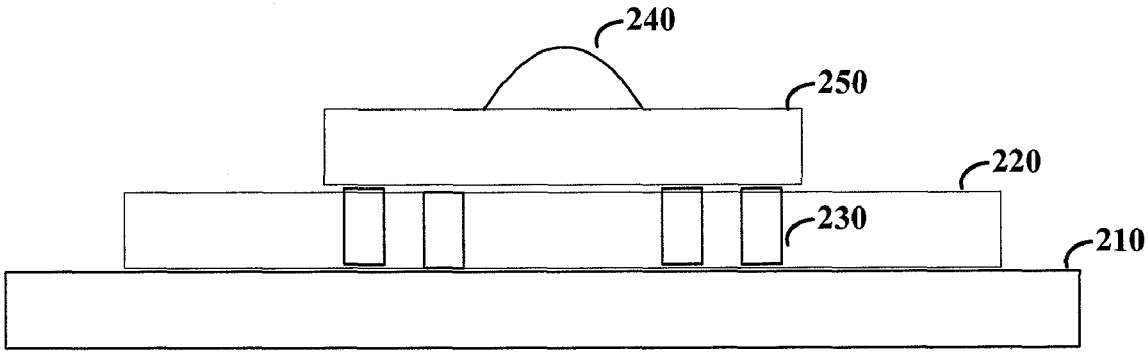
FIG. 2B shows a side view of the light source arrangement of FIG. 2A, according to another example embodiment of the present invention.

FIG. 2B shows a side view of the light source arrangement of FIG. 2A. Light source 240 is thermally connected to thermally conductive material 250, which is connected to thermal channel 230. Thermally conductive material 250 conducts the heat between light source 240 and the various thermal channels. The thermal channels provide thermal conductivity between thermally conductive material 250 and cooling device 210, which dissipates heat from light source 240.

Figure 3:
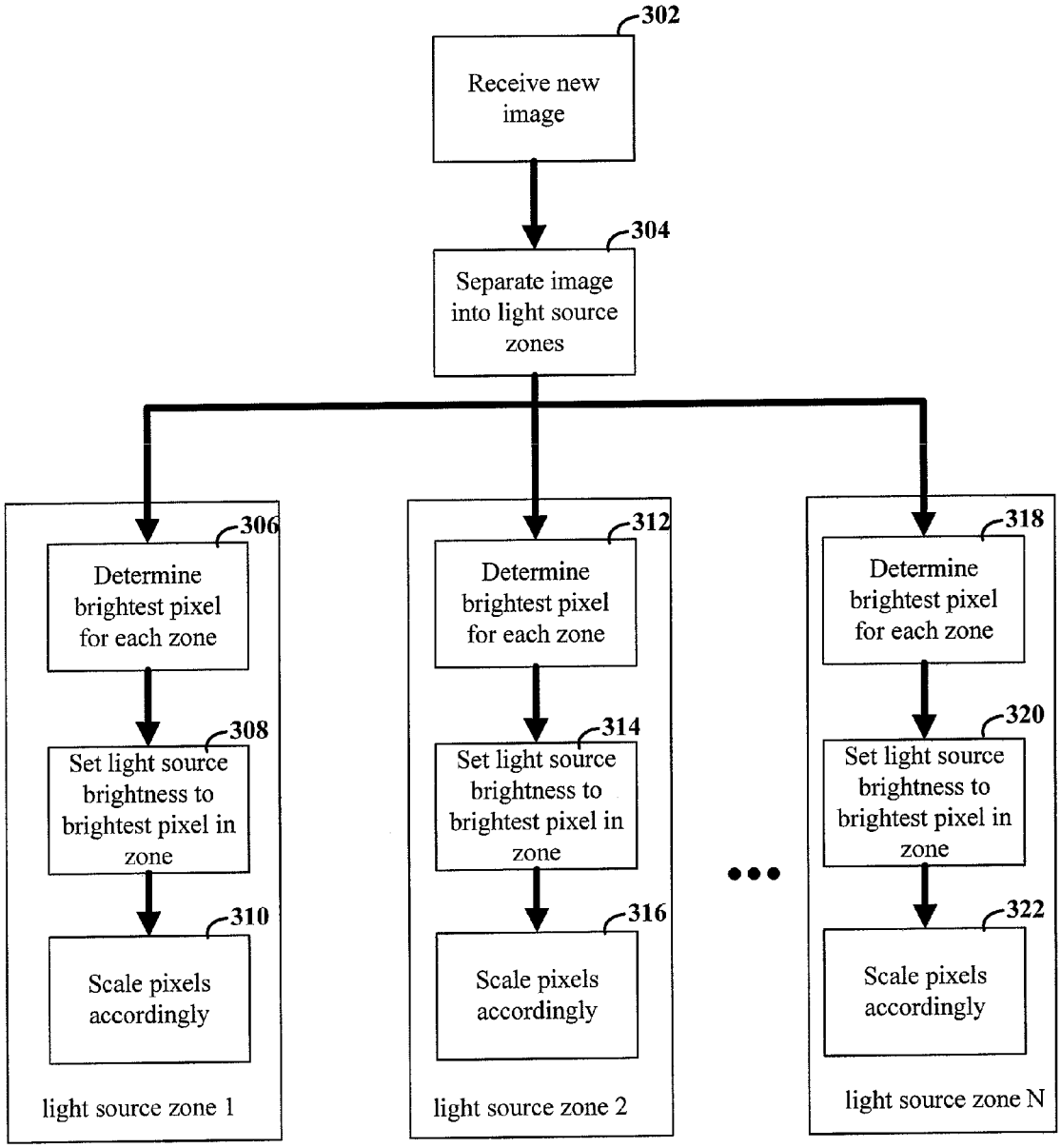
FIG. 3 is a flow diagram for a power saving approach for an attenuating display, according to another example embodiment of the present invention.

FIG. 3 is a flow diagram for a power saving approach for an LCD display, according to another example embodiment of the present invention. The approach shown in FIG. 3 can be performed using, for example, a control arrangement similar to the control 120 shown in FIG. 1 and discussed above. The control arrangement can be implemented using a circuit arrangement, one or more processors, or one or more programmable logic devices. By way of example, the flow diagram in FIG. 3 shows an approach to controlling three light zones; however, the approach shown in FIG. 3 is applicable to use with a multitude of light zones for a variety of implementations.

Image data representing a new image for display is received at block 302. At block 304, the data is separated into sections that correspond to the light-source zones that will be used to eventually display each section. For each zone, the brightest pixel within the section is determined as shown in blocks 306, 312 and 318 respectively for light source zones 1, 2 and N.

Once the brightest pixel for a particular zone is determined, the light source for each such zone is adjusted to correspond to the brightest pixel as shown in blocks 308, 314 and 320. For example, a light source for zone 1 is adjusted to the brightest portion of an image to be displayed via light source zone 1. When the brightness of a light source is adjusted, the attenuation of the pixels in the corresponding light source zone is adjusted accordingly as shown in blocks 310, 316 and 322. Generally, the brightest pixel will have little to no attenuation and the attenuation of the less bright pixels will be scaled according to their brightness relative to the brightest pixel.

In a particular embodiment of the present invention, power dissipated by the light sources is reduced in connection with controlling the brightness of the light sources. For example, many light sources have power dissipation that is proportional to their brightness. Moreover, some attenuation devices draw more power as their attenuation is increased. Thus, the power requirements can be reduced by controlling the brightness of the light sources and the attenuation factor. A slightly reduced but significant reduction in power can also be achieved with attenuation devices being of the nature that less attenuation draws more power, because the fraction of the power consumed by the backlight is dominant over the power consumed by the attenuation devices.

Figure 4:
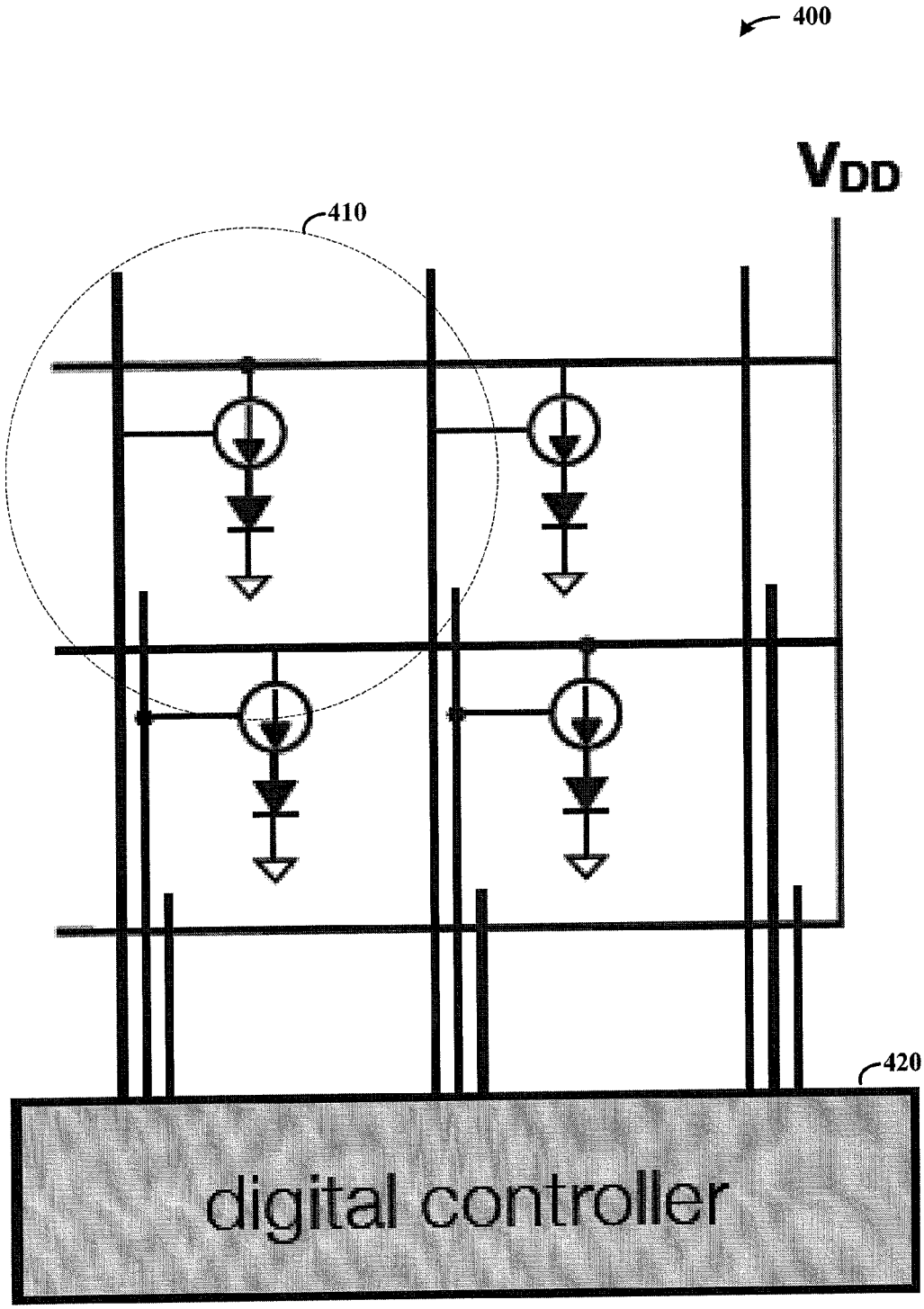
FIG. 4 shows a schematic of a backlight circuit, according to another example embodiment of the present invention.

FIG. 4 shows a schematic of a backlight circuit 400, according to another example embodiment of the present invention. The circuit 400 includes a plurality of light sources controlled by a digital controller 420. By way of example, four light sources are shown, with light source circuit 410 circled and labeled for discussion purposes and shown including a light emitting diode by way of example. While other light sources are readily implemented using this type of circuit approach, the following discussion characterizes an approach involving the use of LEDs.

In one implementation, the backlight circuit 410 includes high brightness LEDs that exhibit about 40 lumen of luminous flux of each, mounted on a standard FR4 PCB. The LCD backlight assembly includes optics and diffuser sheets and achieves a measured homogeneous brightness of about 22,000 cd/m$^2$ incident on an LCD front panel at a power of about 115 W. The combined effect of the optical elements results in an isotropic viewing angle of 53° for the display system. When viewed through an LCD front panel having a measured peak transmittance of 9%, the effective brightness is 2,000 cd/m$^2$.

The digital controller 420 includes driver electronics that independently control each individual LED at different brightness levels via pulse-width modulation or another approach (e.g., to achieve a dynamic range of 1:1000 per LED). A minimum brightness step is determined using the rise-time of the driver electronics.

The digital controller 420 selectively reduces the power supplied to each LED in accordance with the brightness of different portions of an image to be displayed, facilitating a non-linear relationship between LCD brightness and LCD power consumption. Thus, power consumption is reduced (e.g., relative to approaches relying primarily upon attenuation) while maintaining the brightness of an image shown on the LCD. That is, light production is decreased at darker areas of the image, as opposed to increasing front panel attenuation as in conventional designs.

In one application, light power reduction is facilitated by the digital controller 420 with an image subdivided into several blocks (one per LED), by calculating a decomposition into LED brightness and LCD transmittance. The digital controller 420 implements an algorithm to reduce (e.g., minimize) energy consumption by setting at least one LCD pixel of each block to maximum transmittance, allowing for minimal LED brightness. Additionally, the decomposition step ensures a faithful representation of the image.

The backlight circuit 400 described above is readily implemented with a variety of displays. For instance, when combined with a 1:200 dynamic range LCD front panel, high-contrast 1:20,000 images can be displayed, where the potential dynamic range of 1:(1000×200) is reduced by approximately 10× due to internal scattering. The control signals are provided in real time through an FPGA based graphics controller board that accommodates both still images and video display. Various other display types are correspondingly implemented.

Figure 5A:
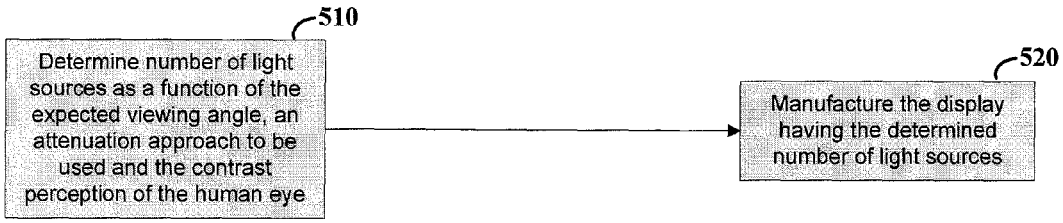
FIG. 5A shows a flow diagram for an approach to determining a number of lights to use in illuminating a display, according to another example embodiment of the present invention.

FIG. 5A shows a flow diagram for an approach to manufacturing an attenuation display, according to another example embodiment of the present invention. The corresponding plot in FIG. 5B and related discussion below describes a more detailed approach that may be implemented with FIG. 5A.

Beginning with FIG. 5A, a number of light sources for an attenuation display arrangement showing image content of known contrast is determined at block 510 using known display attenuation characteristics, a standard known contrast perception of the human eye and a standard known scattering property of the human eye. In connection with this example embodiment, it has been discovered that the number of lights used for a display facilitates increased perceivable contrast up to a threshold, beyond which additional lights do not facilitate any perceivable increase in threshold. This number of light sources is determined for an expected viewing angle, such as a standard angle that is typical for LCD display viewing used with a computer or as a television or video monitor. In this context, the attenuation characteristics are those relevant to the attenuation display and generally characterize the ability of the display to attenuate light (e.g., such that displays exhibiting better attenuation may need less light control to achieve desirable image contrast).

At block 520, the attenuation display is manufactured using the determined number of light sources. In this regard, the number of light sources used to provide light for the display, together with the ability of the display to attenuate light, is set to facilitate a level of contrast that is perceptible by the human eye for the images to be displayed.

Figure 5B:
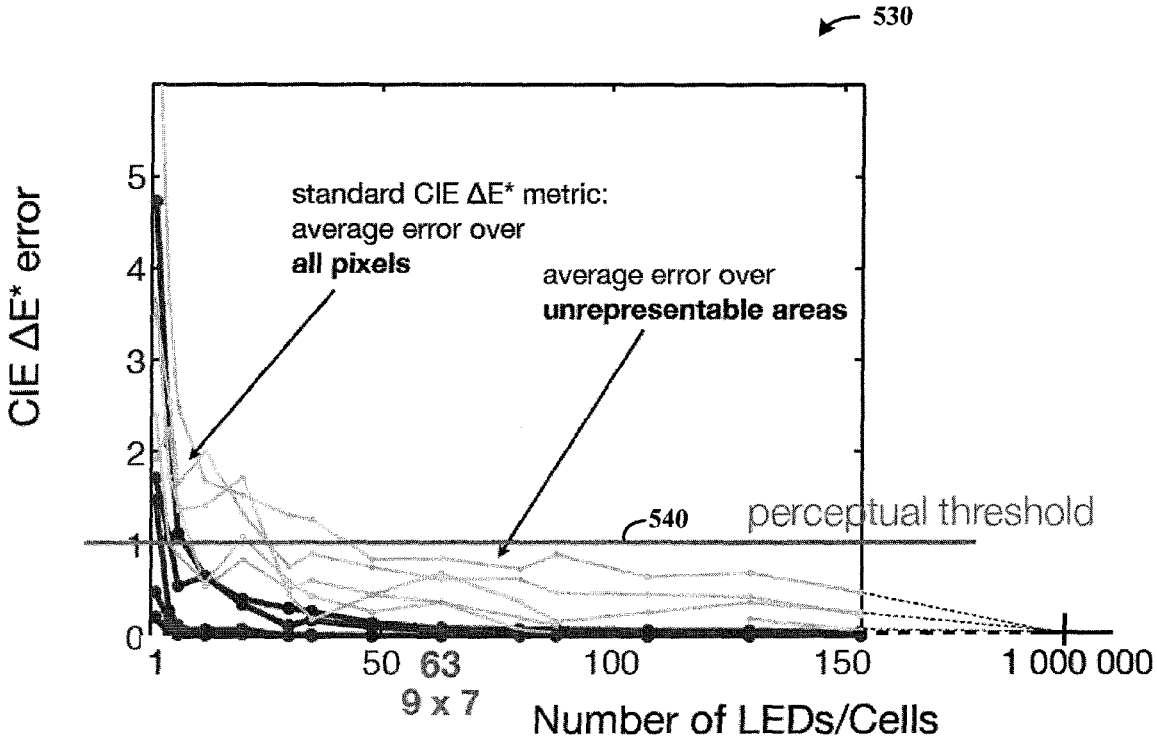
FIG. 5B shows a plot for an approach to determining a number of lights to use in illuminating a display in accordance with the flow diagram in FIG. 5A, according to another example embodiment of the present invention.

FIG. 5B shows a plot 530 showing a number of light cells on the horizontal axis versus image error on the vertical axis, for an approach to determining a number of lights to use in illuminating a display in consideration of contrast perceptible by the human eye, according to another example embodiment of the present invention. As discussed above, this approach may be implemented in connection with the flow diagram in FIG. 5A. A perceptual threshold 540 is shown to represent an amount of contrast that the human eye can perceive; below this threshold, providing even finer contrast resolution is not necessarily beneficial and thus any cost associated with achieving such contrast resolution is mitigated using this example embodiment. In this regard, the number of lights for an attenuation display is selected in accordance with this approach, to facilitate the generation of an image that corresponds to a desirable amount of contrast relative to the perceptual threshold 540 and without incurring undesirable cost.

The above approach to selecting a number of light sources in connection with block 510 of FIG. 5A and the plot 530 in FIG. 5B can be implemented in a variety of manners, depending upon the application. The following approach describes one such approach that may be implemented with block 510. First, an original image is considered (e.g., from a camera) and a distorted image as a display would show it is computed. The original image has more edge contrast than the distorted image because the achievable edge contrast (as any contrast) is set by the achievable attenuation, with the limitation on achievable attenuation being the reason for distortion and why the distorted image cannot fully match the original image.

The original and distorted images are then virtually projected through a human eye onto the retina, by modeling scattering in the eye via an accurate scattering PSF (point spread function). Two retinal images are obtained, one corresponding to the original image and the other to the distorted image. Next, the original and distorted retinal images are compared; if the difference is larger than the perceptual threshold, they are considered different.

The number of light generators in the computation is then increased until the original and distorted retinal images become the same (within the visual threshold accuracy). Using this approach, a desirable number of light generators is determined, beyond which there is little or no advantage in image quality any more. This method/approach is repeated several times for a set of images that are representing the content for which the display is intended. FIG. 5B shows graphs for five sample images. This approach ensures that a correct number of light generators results for a wide range of content to be displayed.

Figure 6:
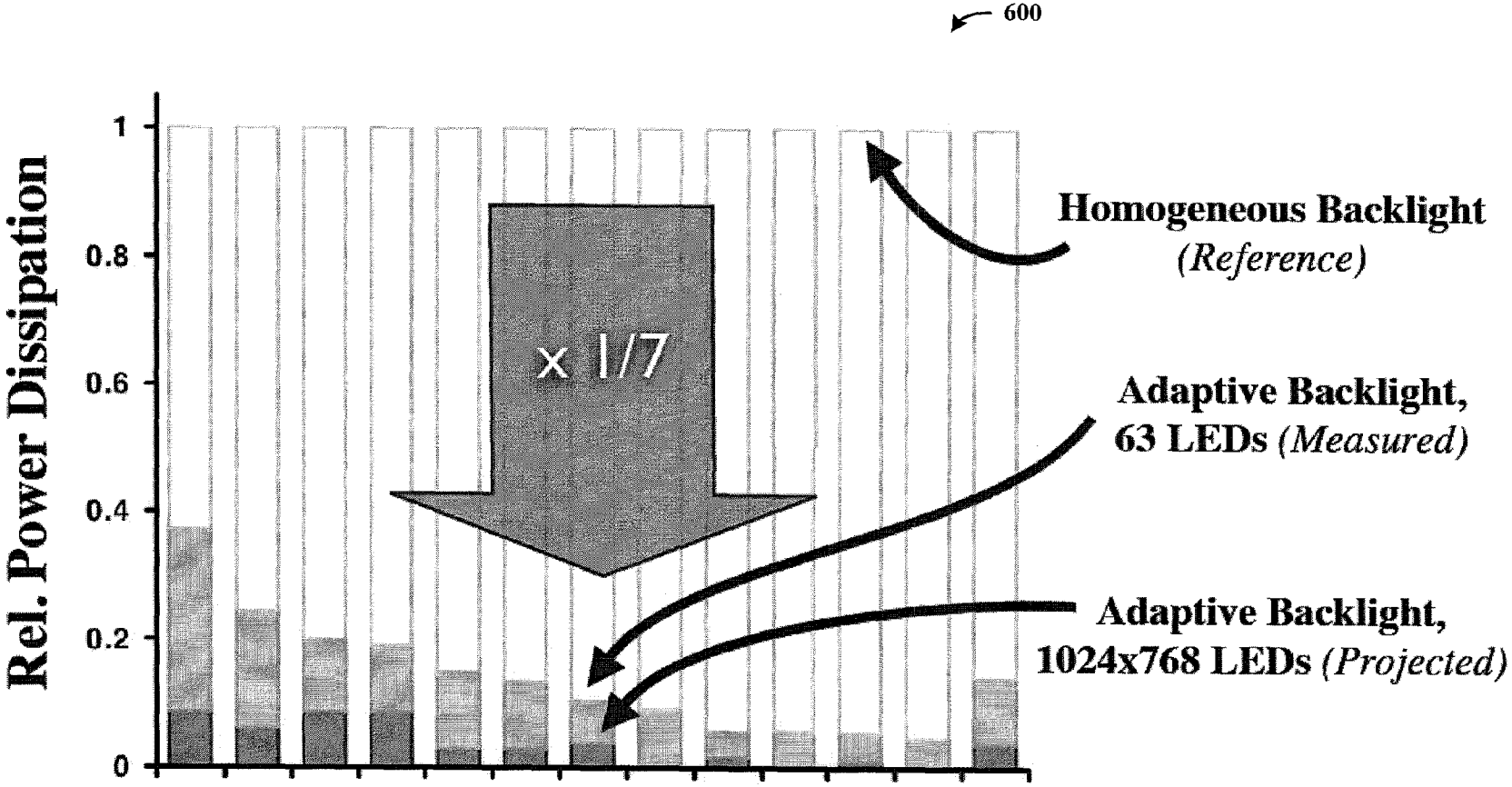
FIG. 6 shows an approach to selecting light sources for a high contrast image, according to another example embodiment of the present invention.
Figure 7:
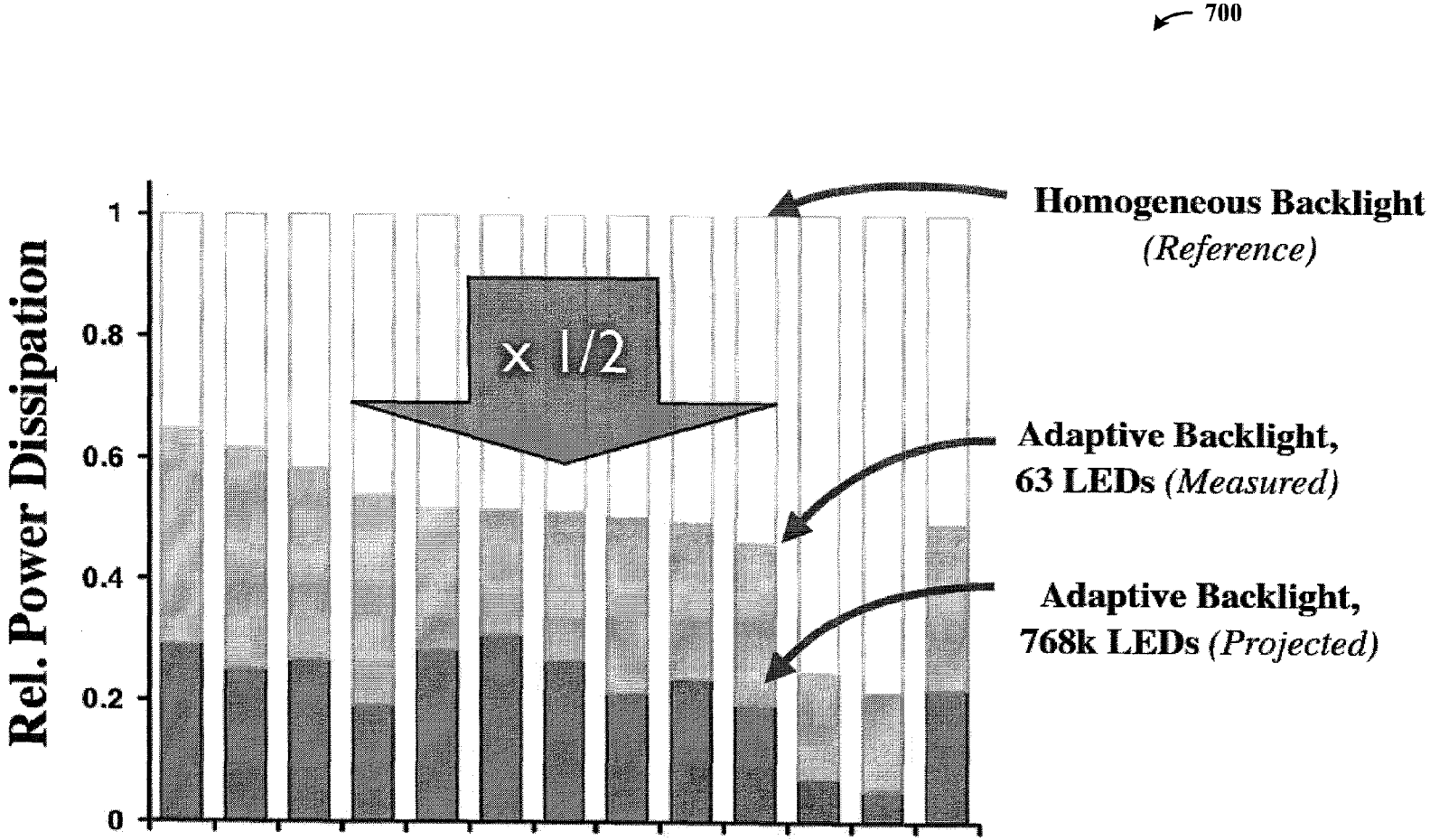
FIG. 7 shows an approach to selecting light sources for a high contrast image, according to another example embodiment of the present invention. While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention as defined by the appended claims.

FIG. 6 shows a plot 600 for an approach to selecting light sources for high contrast images relative to power dissipation, and FIG. 7 shows a corresponding plot 700 for an approach to selecting light generators for low contrast images, according to other example embodiments of the present invention. In each of these figures, a bar graph shows an upper reference using a homogeneous backlight (e.g., a single light or multiple lights at a homogeneous power) against power savings respectively using about 63 and an array of about 1024×768 light generators. The x-axis in these figures indicates 12 different sample images. The 13th bar indicates the average over many representative images of either high contrast (FIG. 6) or low contrast (FIG. 7). High contrast images refer, for example, to images with full scene contrast (no clipping during image capture); low contrast images refer, for example, to standard consumer and producer/professional consumer camera images.

Using the information shown, the number of lights in an array of controllable light generators of an attenuation display arrangement is selected to facilitate power savings relative to the cost and difficulty in implementing large numbers of light generators. This selection is made in accordance with an intended use of the particular display, such as high contrast television displays and relatively low contrast displays such as those implemented for hand-held electronic devices.

In one application, a lower bound of nine light generators (e.g., in a 3×3 or higher array) is used as a baseline. For displays to show images with relatively high variation in contrast with good power savings (e.g., corresponding to FIG. 6), the number of light generators used to facilitate a desirable reduction in power is relatively high, as different portions of the display need to be much brighter than others, thus requiring a finer spacing in the backlight array to adapt correctly the power of the light generators to these steep spatial changes. Correspondingly, for displays to show images with relatively low variation in contrast with good power savings (e.g., corresponding to FIG. 7), the number of light generators used to facilitate a desirable reduction in power is relatively low.

Referring to FIG. 6, a relatively high power-savings benefit of about seven-fold or better is achieved for a display using about 63 light generators (e.g., LEDs), as the reduction in power to light generators supplying light to a relatively dark portion of an image is relatively large. This shown seven-fold saving compares to a maximum possible saving of approximately twenty-eight-fold for a higher resolution array of light generators. Referring to FIG. 7, a power-savings benefit of about two-fold or better is achieved for a display using about 63 light generators, as the reduction of power to light generators applying light to darker portions of the image is less as the image has relatively low contrast differences. This two-fold saving compares to a maximum possible saving of approximately four-fold for a higher resolution array of light generators. Comparing these numbers, the added benefit in power savings achieved by going to higher resolutions is higher in the case of high contrast images.

In each of the above power-savings approaches with FIG. 6 and FIG. 7 and for certain embodiments, image quality is improved in applications where light generators are implemented in connection with a display limited in its attenuation ability. That is, by facilitating desirable contrast, a relative power reduction is also realized via control of the light generators at lower power for image portions exhibiting less brightness.

For general information regarding approaches to image generation, and for specific information regarding imaging approaches that may be implemented in connection with one or more of the various example embodiments described herein, reference may be made to W. Bidermann, A. El Gamal, S. Ewedemi, J. Reyneri, H. Tian, D. Wile, D. Yang, *A 0.18 um High Dynamic Range NTSC/PAL Imaging System-On-Chip with Embedded DRAM Frame Buffer*, in *Proceedings of the IEEE International Solid-State Circuits Conference,* 2003, pp. 212-488, which is fully incorporated herein by reference.

The various embodiments described above and shown in the figures are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. For instance, applications other than LCDs, DLP® technology or LCOS may be amenable to implementation using similar approaches. In addition, one or more of the above example embodiments and implementations may be implemented with a variety of approaches, including digital and/or analog circuitry and/or software-based approaches, as well as those described in connection with the references cited below. These approaches are implemented in connection with various example embodiments of the present invention. Such modifications and changes do not depart from the true scope of the present invention, including that set forth in the following claims.

What is claimed is:

1. A light arrangement for providing light to form an image, the arrangement comprising:

a plurality of light sources, that provide light for respective portions of the image;

a light controller configured and arranged for controlling a brightness level of each light source in response to brightness data for the portion of the image for which the light source is to provide light, the brightness level being controlled independent of another brightness level that is associated with another portion of the image; and an attenuation arrangement to selectively pass light from the light sources.

2. The arrangement of claim 1, wherein the attenuation arrangement controls the amount of light absorbed from the light generated in response to the reduced brightness of said at least one of the light sources and the image.

3. The arrangement of claim 1, wherein the light controller independently controls each light source to facilitate contrast between different portions of the image for which each respective light source provides light.

4. The arrangement of claim 1, wherein the light arrangement provides light to form a video image that changes over time, and for a video image to be displayed at a particular time, the light controller powers a light source that provides light for a brightest portion of the image to generate light corresponding to the brightness of the brightest portion of the image, and powers another of the light sources that provides light for a portion of the image having a brightness that is less than the brightness of the brightest portion of the image at a relatively lower power.

5. The arrangement of claim 1, wherein the light controller independently controls the amount of light generated by each light source to facilitate contrast attenuation of a portion of the display illuminated by each light source as a function of the attenuation of the attenuation arrangement.

6. The arrangement of claim 1, wherein the plurality of light sources consists of a threshold number of light sources that facilitates a difference between an original image and a distorted image that is within a visual threshold accuracy of the human eye, the original image corresponding to an ideal image and the distorted image corresponding to the ideal image as displayed by the light arrangement, such that when implemented with the attenuation arrangement, adding light sources does not facilitate any increase in perceivable contrast relative to light scattering characteristics modeled for a human eye with an accurate scattering point spread function, and removing light sources results in decreased perceivable contrast relative to the light scattering characteristics.

7. The arrangement of claim 1, wherein the light controller and attenuation arrangement are configured and arranged to control the brightness level of each light source by, for each light source, setting the attenuation arrangement to a maximum transmittance for at least one pixel of the portion of the image for which the light source is to provide light, and controlling the brightness level of the light source based upon a brightness of the at least one pixel.

8. An attenuation display arrangement for displaying an image comprising:

a viewing surface;

a backlight arrangement having an array of light sources, each light source arranged to direct light for illuminating a portion of the viewing surface;

a control arrangement to control the amount of light generated by the light sources;

an attenuation arrangement to control the amount of light absorbed from the light sources, prior to the generated light reaching said portion of the viewing surface; and wherein the control arrangement reduces the brightness of said at least one of the light sources in response to a brightness to be displayed on the viewing surface, and the attenuation arrangement controls the amount of light absorbed from the light sources in response to the reduced brightness of said at least one of the light sources and the image.

9. The arrangement of claim 8, further including a printed-circuit-board connected to said at least one of the light sources by a set of thermal channels, and a cooling device connected to the printed-circuit-board using the set of thermal channels.

10. The arrangement of claim 8, wherein the light sources are light-emitting-diodes, the arrangement further including a printed-circuit-board connected to said at least one of the light sources by a set of thermal channels, and a passive cooling device connected to the printed-circuit-board using the set of thermal channels.

11. The arrangement of claim 8, wherein the viewing surface is integrated with the backlight, control and attenuation arrangements.

12. The arrangement of claim 8, wherein the viewing surface is separate from the backlight, control and attenuation arrangements and arranged to reflect light from the back light arrangement that is projected thereupon.

13. A method for displaying images via an attenuation-based display having light sources that each illuminate a subset of pixels for the display, the method comprising, for each subset of pixels:

determining a brightness for a brightest portion of an image to be displayed by the subset of pixels;

controlling the brightness of at least one light source that illuminates the subset of pixels to provide the determined brightness for said brightest portion of an image;

determining an attenuation factor for the subset of pixels in response to the determined brightness, and after light is generated by said at least one light source and before the generated light reaches the subset of pixels, using the attenuation factor to selectively control the amount of the generated light that reaches each pixel in the subset of pixels.

14. The method of claim 13, wherein controlling the brightness includes powering the at least one light source at a power level that facilitates a maximum brightness that corresponds to the determined brightness.

15. The method of claim 13, wherein controlling the brightness includes powering at least two light sources at different power levels to facilitate a different brightness for respective pixels to be illuminated by each of the at least two light sources.

16. The method of claim 13, wherein determining an attenuation factor includes determining attenuation factors for different pixels in the subset of pixels, and using the attenuation factor to selectively control the amount of the generated light that reaches each pixel includes using different attenuation factors for the different pixels in response to an image to be formed.

17. A method for selective power-reduction of the operation of an attenuation-based display having light sources that each illuminate a set of pixels for a displayable area of the display, the method including the steps of:

for at least one of the light sources, determining a brightness level based upon a desired brightness for a first set of pixels that are illuminated by said at least one of the light sources in accordance with a portion of an image to be displayed via the first set of pixels;

controlling the brightness of said at least one of the light sources in response to the step of determining a brightness level;

determining an attenuation factor for the first set of pixels in response to the step of controlling the brightness and in response to an image to be displayed; and in response to the attenuation factor, controlling the ratio of light generated by the light source that reaches the displayable area to light generated by the light source that does not reach the displayable area.

18. The method of claim 17, wherein the step of determining a brightness level includes determining a brightness level for different light sources that illuminate different sets of pixels, and the step of controlling the brightness includes independently controlling the brightness of the different light sources in response to the determined brightness level for each light source.

19. The method of claim 17, wherein the steps of controlling the brightness includes controlling the brightness in response to an ability of the attenuation-based display to attenuate light.

20. A method for manufacturing an attenuation display illuminated with a plurality of individually-controllable light sources that are attenuated with an attenuation arrangement, the method comprising:

arranging a number of light sources for generating an image as a function of an expected viewing angle of the display, the attenuation capabilities of the attenuation arrangement and human eye light scattering characteristics, characterized in that the number of light sources is about a threshold number of light sources for which, when implemented with the attenuation display arrangement, adding light sources does not facilitate any increase in perceivable contrast relative to the light scattering characteristics, and removing light sources results in decreased perceivable contrast relative to the light scattering characteristics.

21. The method of claim 20, wherein arranging a number of light sources includes arranging the number of light sources as a function of attenuation characteristics of the attenuation display.

22. The method of claim 20, wherein arranging a number of light sources for generating an image as a function of an expected viewing angle of the display, the attenuation capabilities of the attenuation arrangement and human eye light scattering characteristics includes virtually projecting an original image and a distorted image through a human eye onto the retina by modeling scattering in the eye with an accurate scattering point spread function, the original image corresponding to an ideal image and the distorted image corresponding to the ideal image as the attenuation display would show it, obtaining two retinal images, one corresponding to the original image and the other to the distorted image, comparing the two retinal images to determine whether a difference between the images is larger than a perceptual threshold corresponding to the human eye, and setting the number of arranged light sources to correspond to a number of light sources that facilitates a difference between the images that is within a visual threshold accuracy of the human eye.

23. An apparatus for illuminating a video display, the apparatus comprising:

first and second light sources respectively configured and arranged to illuminate first and second portions of the video display; and a light controller configured and arranged to control a brightness level of the first light source based upon brightness characteristics of pixel data for pixels to be displayed on the first portion of the video display, independent of the brightness level of pixels to be displayed on a different portion of the video display, control a brightness level of the second light source based upon brightness characteristics of pixel data for pixels to be displayed on the second portion of the video display, independent of the brightness level of pixels to be displayed on a different portion of the video display.

24. An apparatus for controlling light sources to illuminate portions of a video display, the apparatus comprising:

a first light driver circuit configured and arranged to control a brightness level of a first one of the light sources based upon brightness characteristics of pixel data for pixels to be displayed on a portion of the video display illuminated by the first one of the light sources, independent of brightness characteristics of pixel data for pixels to be displayed on a different portion of the video display; and a second light driver circuit configured and arranged to control a brightness level of a second one of the light sources based upon brightness characteristics of pixel data for pixels to be displayed on a portion of the video display illuminated by the second one of the light sources, independent of brightness characteristics of pixel data for pixels to be displayed on a different portion of the video display.

* * * * *